US011519112B2

(12) United States Patent
Baghernejad et al.

(10) Patent No.: US 11,519,112 B2
(45) Date of Patent: Dec. 6, 2022

(54) COMPUTERIZED NUMERIC CONTROL (CNC) AUTOMATIC SEWING MACHINE

(71) Applicants: Abbas Baghernejad, Shiraz (IR); Arash Rahmanirezaeiyeh, Urmia (IR)

(72) Inventors: Abbas Baghernejad, Shiraz (IR); Arash Rahmanirezaeiyeh, Urmia (IR)

( * ) Notice: Subject to any disclaimer, the term of this patent is extended or adjusted under 35 U.S.C. 154(b) by 47 days.

(21) Appl. No.: 17/165,829

(22) Filed: Feb. 2, 2021

(65) Prior Publication Data

US 2021/0156061 A1 May 27, 2021

Related U.S. Application Data

(60) Provisional application No. 62/980,458, filed on Feb. 24, 2020.

(51) Int. Cl.
*D05B 19/16* (2006.01)
*D05B 19/14* (2006.01)

(52) U.S. Cl.
CPC ..... *D05B 19/16* (2013.01); *D05B 19/14* (2013.01)

(58) Field of Classification Search
CPC ..... D05B 19/16; D05B 21/00; D05B 27/04; D05B 27/10; D05B 27/16; D05B 39/00; D05C 9/04
See application file for complete search history.

(56) References Cited

U.S. PATENT DOCUMENTS

| | | | | |
|---|---|---|---|---|
| 3,082,721 | A * | 3/1963 | Bono | D05B 27/24 269/254 R |
| 5,503,093 | A * | 4/1996 | Katou | D05B 21/00 112/475.18 |
| 8,794,166 | B2 * | 8/2014 | Makover | D05C 9/02 112/102.5 |
| 8,978,567 | B2 * | 3/2015 | Makover | D05B 27/10 112/103 |
| 9,150,991 | B1 * | 10/2015 | Kalkbrenner | D05B 21/002 |
| 2013/0074749 | A1 * | 3/2013 | Kato | D05B 19/02 112/102.5 |
| 2015/0240401 | A1 * | 8/2015 | Kobayashi | D05B 35/06 112/102.5 |
| 2016/0230323 | A1 * | 8/2016 | Nakajima | D05B 29/10 |

* cited by examiner

*Primary Examiner* — Nathan E Durham
(74) *Attorney, Agent, or Firm* — Bajwa IP Law Firm; Haris Zaheer Bajwa

(57) ABSTRACT

A computerized sewing machine may include a workpiece supporting base, a sewing head, a workpiece moving assembly configured to move the workpiece relative to the sewing head on the workpiece supporting base. The workpiece moving assembly may be configured to drive a translational movement of the workpiece relative to the sewing head and a rotational movement of the workpiece about a longitudinal axis of the sewing head. A controller may be coupled with the workpiece moving assembly. The controller may include a memory to store computerized sewing instructions corresponding to a plurality of sewing patterns, and a processor coupled with the memory that may be configured to read the computerized sewing instructions from the at least one memory and to urge the workpiece moving assembly to move the workpiece relative to the sewing head on the workpiece supporting base in accordance with the computerized sewing instructions.

15 Claims, 14 Drawing Sheets

COMPUTERIZED NUMERIC CONTROL (CNC) AUTOMATIC SEWING MACHINE

CROSS-REFERENCE TO RELATED APPLICATION

This application claims the benefit of priority from pending U.S. Provisional Patent Application Ser. No. 62/980,458, filed on Feb. 24, 2020, and entitled "CNC SEWING MACHINE," which is incorporated herein by reference in its entirety.

TECHNICAL FIELD

The present disclosure generally relates to sewing machines, particularly automatic sewing machines. More particularly, the present disclosure relates to computerized numerical control (CNC) sewing machines for sewing and cutting materials such as textile or leather along continuous long sewing or cutting curves.

BACKGROUND

A mechanical sewing machine is a basic sewing machine that may be used for sewing fabric together by thread. Mechanical sewing machines may be utilized for making plain stich types, such as lockstitches, chainstitches, overlocks, and cover stitches. Some high-end mechanical sewing machines may allow for making decorative and buttonhole stiches as well. However, most mechanical sewing machines may not make precise stiches or may not be used for embroidery applications, due to the fact that in most mechanical sewing machines, a textile must be moved under a sewing needle by hand.

Computerized sewing machines, such as computerized numerically controlled (CNC) sewing machines were developed to allow for performing very precise stiches, as well as, creating highly elaborate stitching designs. Such computerized sewing machines may include built-in programs or may be further programmed to perform quilting, embroidery, or heavy-duty projects. Such versatility of computerized sewing machines along with their many automated features, such as tension adjustment, bobbin winder, thread cutter, locking straight stitch function for reinforcing seams, and auto-tying to secure the ends of the seam may save time and make sewing that much easier.

However, despite many advantages of computerized sewing machines, they are expensive, complex, spacious, and difficult to work with. Specifically, when it comes to performing complex infinite sewing lines or cutting lines, due to the limitations of control mechanisms, large and more complex sewing/cutting machines may be required.

There is, therefore, a need for a computerized sewing machine that may provide a user with all advantages of an automatic sewing machine, such as precise and complex stitching and versatility, while maintaining comfort, simplicity, and affordability of a basic mechanical sewing machine. There is further a need for a computerized sewing machine that may allow for performing infinite cutting/sewing lines, which may be considered crucial, especially in mass production applications.

SUMMARY

This summary is intended to provide an overview of the subject matter of the present disclosure and is not intended to identify essential elements or key elements of the subject matter, nor is it intended to be used to determine the scope of the claimed implementations. The proper scope of the present disclosure may be ascertained from the claims set forth below in view of the detailed description and the drawings.

According to one or more exemplary embodiments, the present disclosure is directed to a computerized sewing machine. An exemplary computerized sewing machine may include a workpiece supporting base, a sewing head, and a workpiece moving assembly that may be configured to move an exemplary workpiece relative to an exemplary sewing head on an exemplary workpiece supporting base.

An exemplary workpiece moving assembly may include a first actuating mechanism that may be configured to drive a translational movement of an exemplary workpiece relative to an exemplary sewing head, and a second actuating mechanism that may be configured to drive a rotational movement of the first actuating mechanism relative to the sewing head about a longitudinal axis of the sewing head.

An exemplary first actuating mechanism may include a tray with a central hole, where a top surface of an exemplary tray may face away from an exemplary workpiece supporting base and an opposing bottom surface of an exemplary tray may face an exemplary workpiece supporting base. An exemplary first actuating mechanism may further include at least one motorized omni wheel that may be attached to an exemplary bottom surface of an exemplary tray, where a plain of rotation of the at least one motorized omni wheel may be perpendicular to a plane of rotation of an exemplary tray. An exemplary central hole of an exemplary tray may be configured to allow for an exemplary sewing head to pass through an exemplary central hole.

An exemplary second actuating mechanism may include a rotary motor that may be mounted in a fixed position relative to an exemplary sewing head, and a timing belt that may be coupled between an exemplary rotary motor and an exemplary tray. An exemplary timing belt may be configured to transfer a rotational movement of an exemplary rotary motor to an exemplary tray.

An exemplary computerized sewing machine may further include a controller that may be coupled with an exemplary workpiece moving assembly. An exemplary controller may include at least one memory configured to store computerized sewing instructions, the computerized sewing instructions corresponding to a plurality of sewing patterns, and at least one processor coupled with the at least one memory. An exemplary processor may be configured to read exemplary computerized sewing instructions from an exemplary memory. An exemplary processor may further be configured to urge an exemplary workpiece moving assembly to move an exemplary workpiece relative to an exemplary sewing head on an exemplary workpiece supporting base in accordance with exemplary computerized sewing instructions.

BRIEF DESCRIPTION OF THE DRAWINGS

The novel features which are believed to be characteristic of the present disclosure, as to its structure, organization, use and method of operation, together with further objectives and advantages thereof, will be better understood from the following drawings in which a presently preferred embodiment of the present disclosure will now be illustrated by way of example. It is expressly understood, however, that the drawings are for illustration and description only and are not intended as a definition of the limits of the present disclosure. Embodiments of the present disclosure will now be described by way of example in association with the accompanying drawings in which.

DETAILED DESCRIPTION

The novel features which are believed to be characteristic of the present disclosure, as to its structure, organization, use and method of operation, together with further objectives and advantages thereof, will be better understood from the following discussion.

The present disclosure is directed to exemplary embodiments of a computerized sewing machine that may allow for performing curved and long stitches automatically on a workpiece, such as textile or leather. An exemplary computerized sewing machine may include two actuating mechanism that may provide two degrees of freedom for moving an exemplary workpiece relative to a sewing head. A first exemplary actuator may include at least one motorized omni wheel that may contact a top surface of an exemplary workpiece. An exemplary motorized omni wheel may refer to a wheel with small rollers around the circumference of the wheel, which may be perpendicular to a turning direction of the wheel. When an exemplary motorized omni wheel assumes a rotational movement, it may move an exemplary workpiece along a translational axis perpendicular to a rotational axis of the exemplary motorized omni wheel. A second exemplary actuator may be utilized for changing a direction of the movement of an exemplary motorized omni wheel. In other words, an exemplary second actuating mechanism may be utilized for rotating an exemplary motorized omni wheel of an exemplary first actuating mechanism with respect to an exemplary sewing head.

An exemplary computerized sewing machine may further include an exemplary controller that may include computerized sewing instructions. An exemplary controller may be coupled with exemplary first and second actuating mechanisms of an exemplary computerized sewing machine and may utilize degrees of freedom provided by the aforementioned actuating mechanisms to move an exemplary workpiece relative to an exemplary sewing head in accordance with the computerized sewing instruction.

Figure 1:
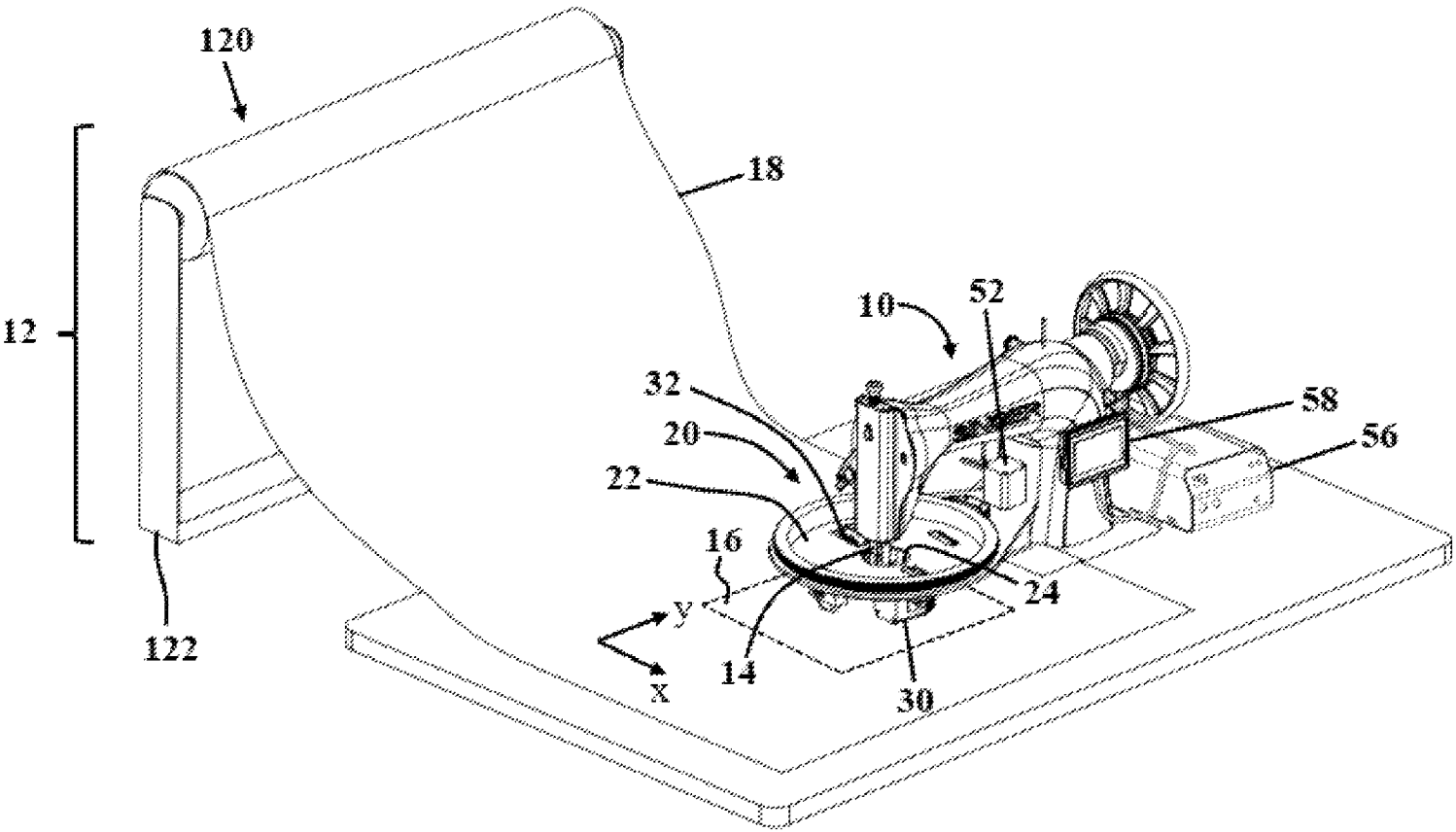
FIG. 1 illustrates a perspective view of a computerized sewing machine coupled with a workpiece feeding mechanism, consistent with one or more exemplary embodiments of the present disclosure.
Figure 2:
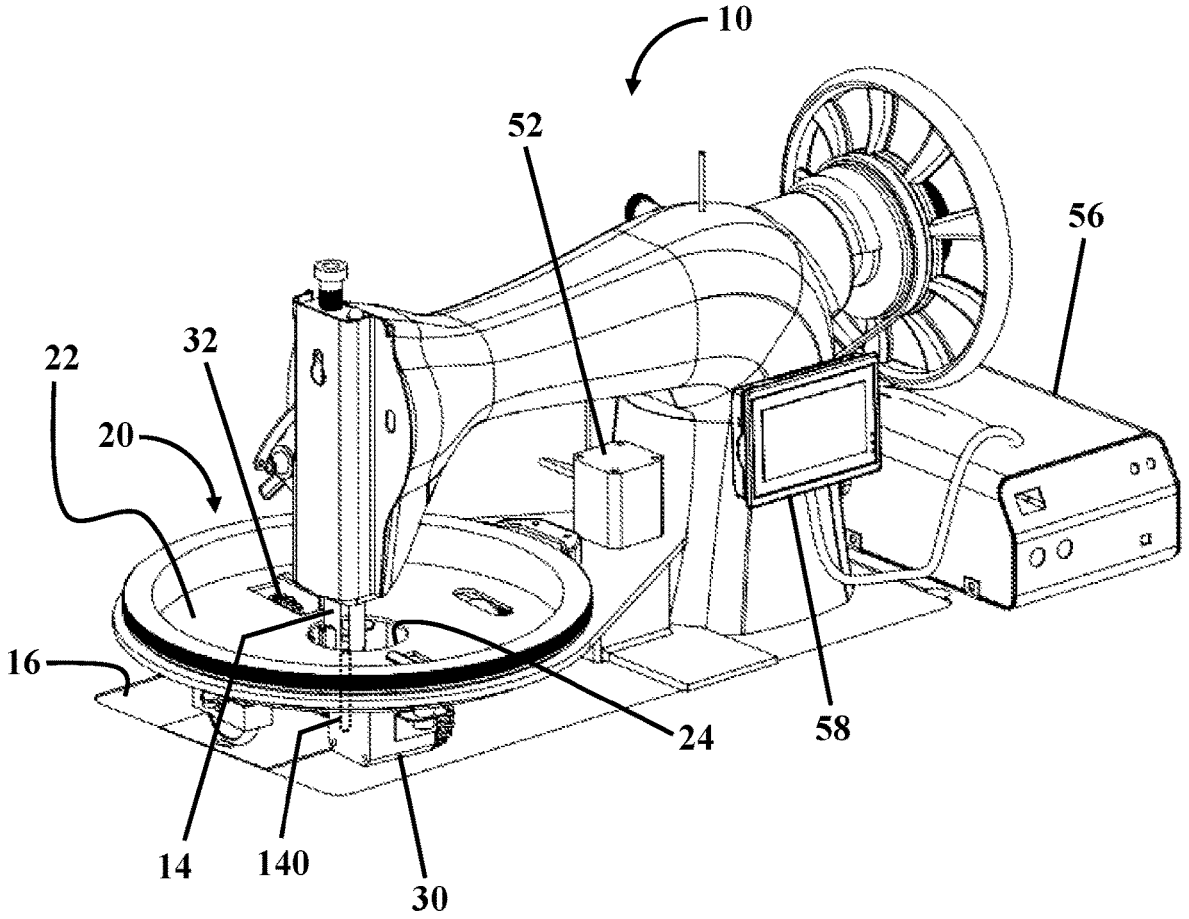
FIG. 2 illustrates a perspective view of a computerized sewing machine, consistent with one or more exemplary embodiments of the present disclosure.

FIG. 1 illustrates a perspective view of a computerized sewing machine 10 coupled with a workpiece feeding mechanism 12, consistent with one or more exemplary embodiments of the present disclosure. FIG. 2 illustrates a perspective view of a computerized sewing machine 10, consistent with one or more exemplary embodiments of the present disclosure.

In an exemplary embodiment, computerized sewing machine 10 may include a sewing head 14 and workpiece support base 16 below sewing head 14. In an exemplary embodiment, workpiece support base 16 may be a sewing bed. In an exemplary embodiment, sewing head 14 may include an extended sewing needle 140 that may be mounted above workpiece support base 16 and perpendicular to workpiece support base 16. In an exemplary embodiment, a workpiece 18, such as textile or leather, may be fed into computerized sewing machine 10 utilizing workpiece feeding mechanism 12, which may be a roll 120 of workpiece 18 stored on a rack 122. In an exemplary embodiment, workpiece 18 may be fed into computerized sewing machine 10 such that a portion of workpiece 18 that is to be stitched or embraided on may be placed on a top surface of workpiece support base 16 and may slip over workpiece support base 16 relative to sewing head 14 when urged by a workpiece moving assembly, as will be discussed in further detail below. In an exemplary embodiment, sewing head 14 of computerized sewing machine 10 may include a driving mechanism for extended sewing needle 140 to perform stitching like a normal sewing machine. In an exemplary embodiment, a detailed structure and functionality of sewing head 14 is not described here for the sake of simplicity.

In an exemplary embodiment, in order to stich workpiece 18 according to a pattern, workpiece 18 may be moved relative to extended sewing needle 140 in accordance with that pattern. In an exemplary embodiment, an exemplary pattern may be a set of computerized sewing instructions received from a user via a user interface unit of computerized sewing machine 10 or a computerized sewing instruction chosen by a user from a plurality of computerized sewing instructions already stored on computerized sewing machine 10, as will be discussed. In an exemplary embodiment, computerized sewing machine 10 may further include a workpiece moving assembly 20 that may be configured to move workpiece 18 relative to sewing head 14 on workpiece support base 16 along two perpendicular axes (x and y) on a plane of workpiece support base 16.

Figure 3:
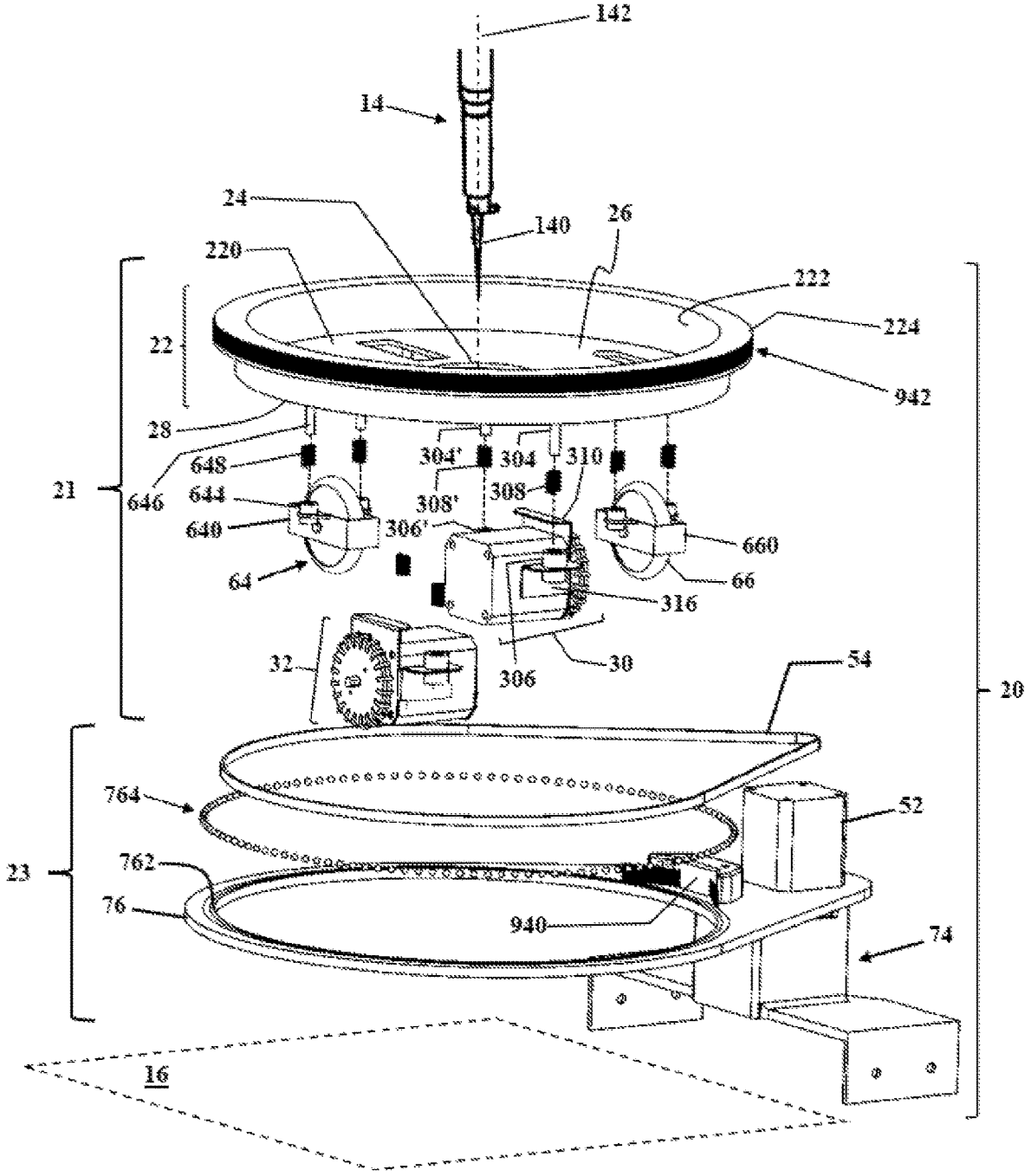
FIG. 3 illustrates an exploded view of a workpiece moving assembly, consistent with one or more exemplary embodiments of the present disclosure.

FIG. 3 illustrates an exploded view of workpiece moving assembly 20, consistent with one or more exemplary embodiments of the present disclosure. In an exemplary embodiment, workpiece moving assembly 20 may include a first actuating mechanism 21 that may be configured to drive a translational movement of workpiece 18 relative to sewing head 14 along a radial direction and a second actuating mechanism 23 that may be configured to drive a rotational movement of first actuating mechanism 21 relative to sewing head 14 about a longitudinal axis 142 of sewing head 14. As used herein, a longitudinal axis of an object may refer to an axis associated with the longest dimension of that object.

In an exemplary embodiment, first actuating mechanism 21 may include a tray 22 with a central hole 24. A top surface 26 of tray 22 may face away from workpiece support base 16 and an opposing bottom surface 28 of tray 22 may face workpiece support base 16. In an exemplary embodiment, central hole 24 may be configured to allow for sewing head 14 to pass through central hole 24. In an exemplary embodiment, during a sewing or embroidering process, sewing head 14, specifically, extended sewing needle 140 may have vertical reciprocating motions along longitudinal axis 142 through central hole 24. In other words, central hole 24 may be configured to provide sewing head 14 with access to an exemplary workpiece that may be supported on workpiece support base 16.

In an exemplary embodiment, first actuating mechanism 21 may further include one or more motorized omni wheels, such as a first motorized omni wheel 30 and a second motorized omni wheel 32 that may be attached to bottom surface 28 of tray 22. As used herein, a motorized omni wheel may refer to an omni-directional wheel capable of moving in all directions, the structure of which may be further described in connection with FIG. 5. In an exemplary embodiment, tray 22 may further include two slits (60*a* and 60*b*) that may allow for top halves of first motorized omni wheel 30 and second motorized omni wheel 32 to be accommodated within two slits (60*a* and 60*b*). A plain of rotation of each motorized omni wheel of the one or more motorized omni wheels may be perpendicular to a plane of rotation of tray 22. For example, a plain of rotation of first motorized omni wheel 30 may be perpendicular to the plane of rotation of tray 22, and similarly, a plain of rotation of second motorized omni wheel 32 may be perpendicular to the plane of rotation of tray 22. In an exemplary embodiment, the plane of rotation of first motorized omni wheel 30 may be parallel with the plane of rotation of second motorized omni wheel 32 and they may be rotated either simultaneously or individually. In an exemplary embodiment, an axis of rotation of first motorized omni wheel 30 may be parallel with an axis of rotation of second motorized omni wheel 32.

In an exemplary embodiment, the one or more motorized omni wheels of the first actuating mechanism 21 may engage workpiece 18, such that rotational movement of the one or more motorized omni wheels may urge workpiece 18 to slip over workpiece support base 16 relative to sewing head 14. As used herein, each motorized omni wheel of the one or more motorized omni wheels being engaged with workpiece 18 may refer to no slip between an outer surface of each motorized omni wheel of the one or more motorized omni wheels and workpiece 18. No slip condition may refer to each motorized omni wheel of the one or more motorized omni wheels not slipping on workpiece 18. In an exemplary embodiment, the one or more motorized omni wheels not slipping on workpiece 18 may refer to the one or more motorized omni wheels pressing down workpiece 18 onto workpiece support base 16. When the one or more motorized omni wheels rotate, they may grab workpiece 18 and move it relative to sewing head 14 on workpiece support base 16.

Figure 4A:
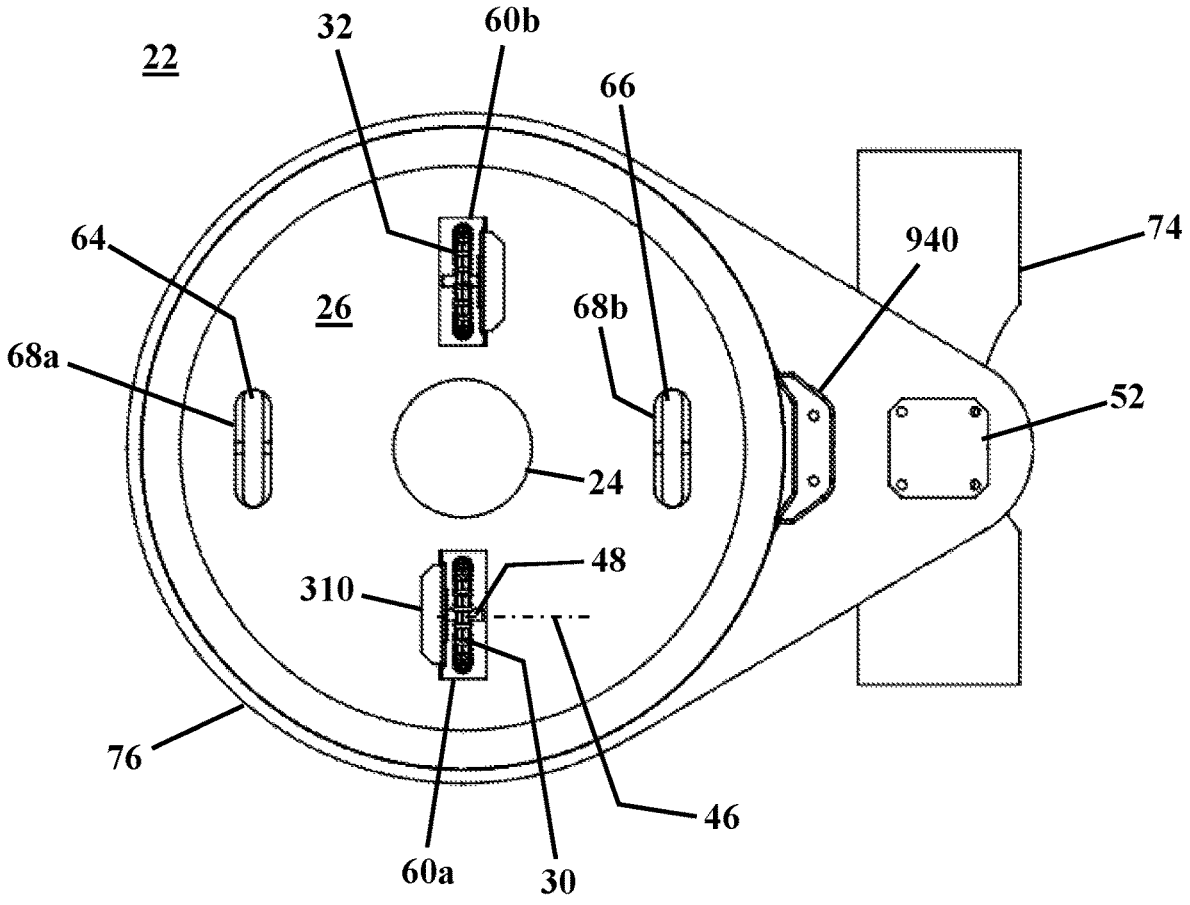
FIG. 4A illustrates a top view of a workpiece moving assembly, consistent with one or more exemplary embodiments of the present disclosure.
Figure 4B:
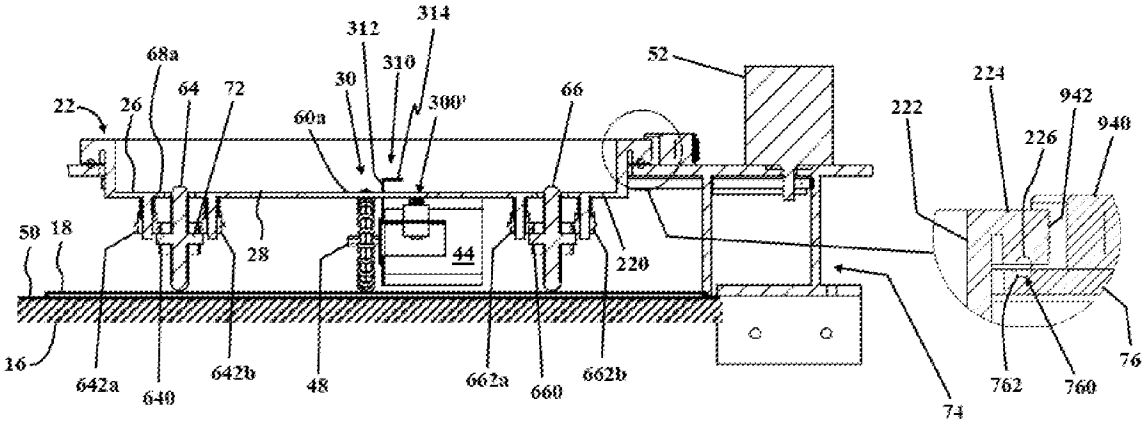
FIG. 4B illustrates a sectional side view of a workpiece moving assembly, consistent with one or more exemplary embodiments of the present disclosure.
Figure 4C:
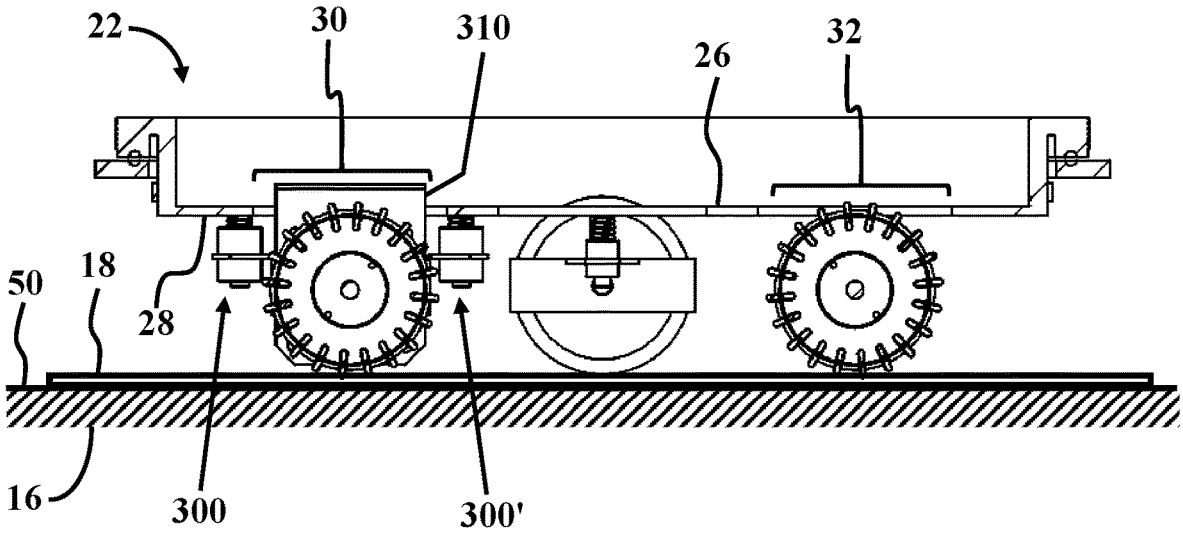
FIG. 4C illustrates a sectional front view of a workpiece moving assembly, consistent with one or more exemplary embodiments of the present disclosure.

FIG. 4A illustrates a top view of workpiece moving assembly 20, consistent with one or more exemplary embodiments of the present disclosure. FIG. 4B illustrates a sectional side view of workpiece moving assembly 20, consistent with one or more exemplary embodiments of the present disclosure. FIG. 4C illustrates a sectional front view of workpiece moving assembly 20, consistent with one or more exemplary embodiments of the present disclosure.

Figure 5A:
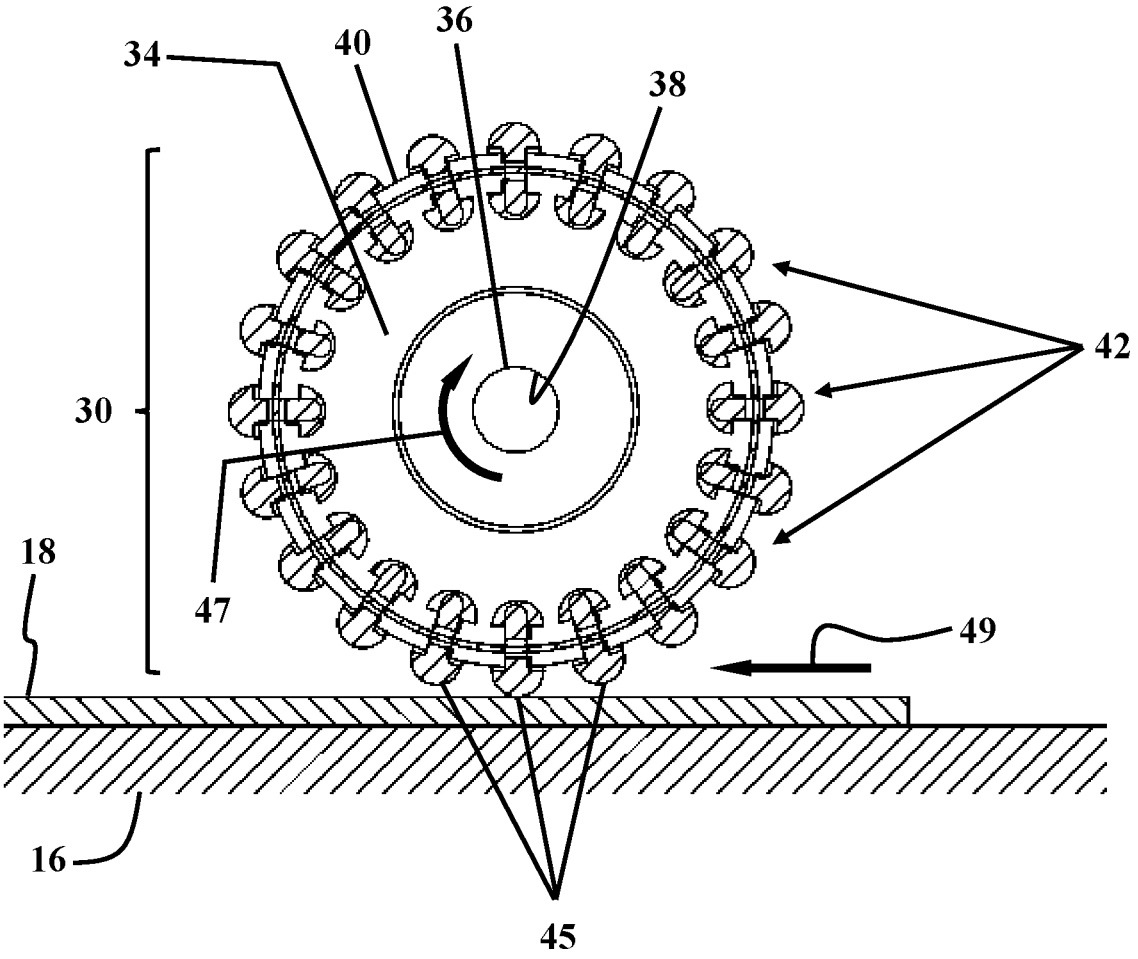
FIG. 5A illustrates a sectional front view of a first motorized omni wheel, consistent with one or more exemplary embodiments of the present disclosure.
Figure 5B:
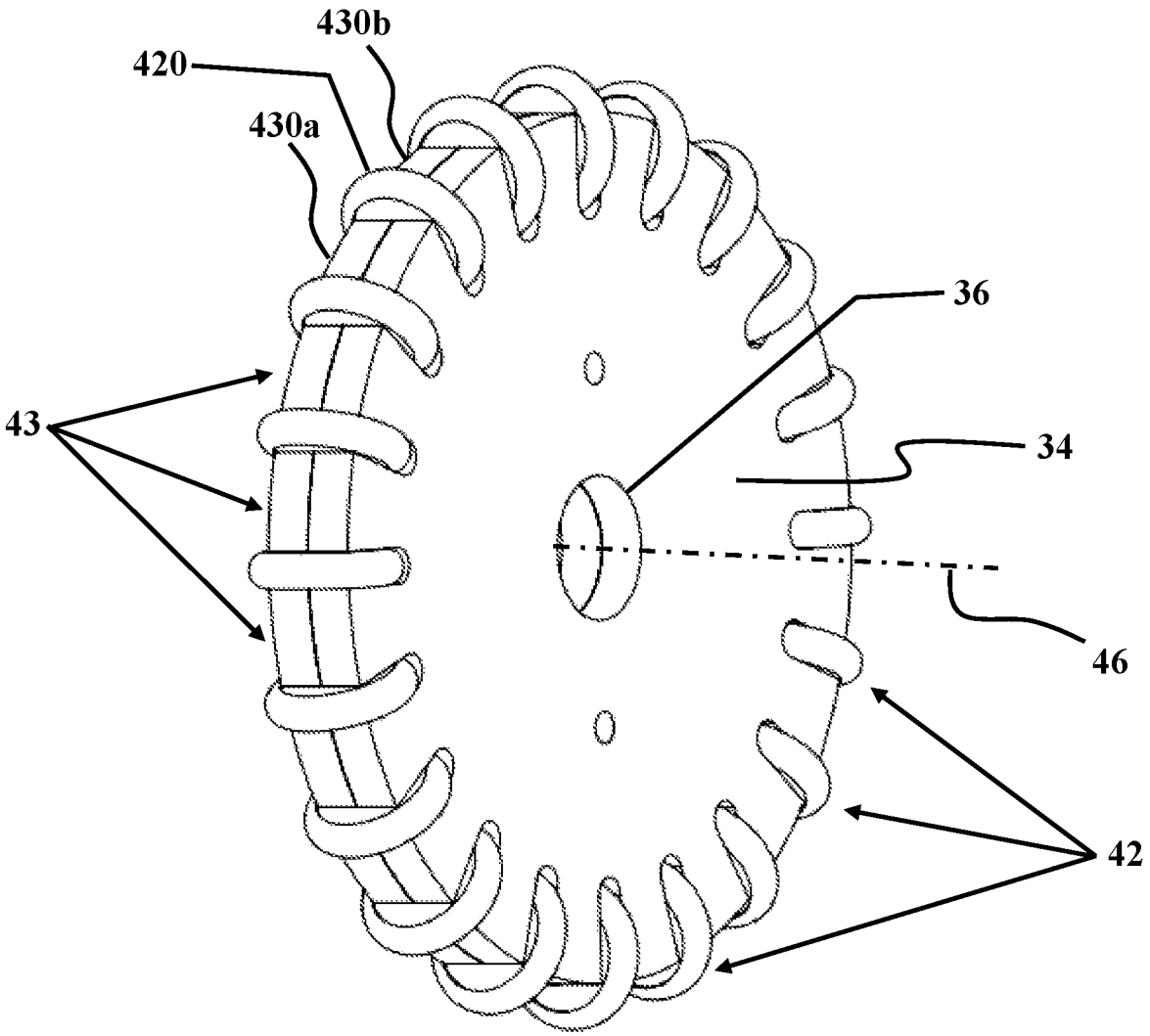
FIG. 5B illustrates a perspective view of a first motorized omni wheel, consistent with one or more exemplary embodiments of the present disclosure.

FIG. 5A illustrates a sectional front view of first motorized omni wheel 30, consistent with one or more exemplary embodiments of the present disclosure. FIG. 5B illustrates a perspective view of first motorized omni wheel 30, consistent with one or more exemplary embodiments of the present disclosure.

In an exemplary embodiment, each motorized omni wheel of the one or more motorized omni wheels may include a main wheel with a central bore, where the main wheel may extend radially outward from an inner rim provided by the central bore to an outer periphery rim. For example, first motorized omni wheel 30 may include a main wheel 34 with a central bore 36, where main wheel 34 may extend radially outward from an inner rim 38 provided by central bore 36 to an outer periphery rim 40. In other words, main wheel 34 may be a discoid with central bore 36 that may be rotatable about a normal axis of the discoid.

In an exemplary embodiment, each motorized omni wheel of the one or more motorized omni wheels may further include a plurality of idler wheels that may be rotatably mounted on the outer periphery rim of the main wheel. In an exemplary embodiment, the plurality of idler wheels may be peripherally spaced and may be laterally rotatable. For example, first motorized omni wheel 30 may further include a plurality of idler wheels 42 that may be rotatably mounted on outer periphery rim 40 of main wheel 34.

In an exemplary embodiment, main wheel 34 may further include extended teeth radially extended outward from outer periphery rim 40 of main wheel 34. In an exemplary embodiment, each idler wheel of plurality of idler wheels 42 may be mounted on outer periphery rim 40 of main wheel 34 between each pair of adjacent spaced apart teeth utilizing bearing units (not illustrated) attached to outer periphery rim 40. For example, idler wheel 420 may be mounted on outer periphery rim 40 of main wheel 34 between adjacent spaced apart teeth 430*a* and 430*b* utilizing a bearing unit (not illustrated) mounted between teeth 430*a* and 430*b*.

In an exemplary embodiment, plurality of idler wheels 42 may be peripherally spaced and may be laterally rotatable. In an exemplary embodiment, a lateral plane of rotation of each idler wheel of the plurality of idler wheels may be perpendicular to a plane of rotation of the main wheel. For example, a lateral plane of rotation of each idler wheel of plurality of idler wheels 42 may be perpendicular to a plane of rotation of main wheel 34. In other words, each idler wheel of plurality of idler wheels 42 may be a small disc roller that may rotate about a rotational axis perpendicular to normal axis 46 of main wheel 34. Such orientation of rotational axis of each idler wheel of plurality of idler wheels 42 may allow for first motorized omni wheel 30 to perform lateral slides when first motorized omni wheel 30 is rotated by tray 22 about longitudinal axis 142 of sewing head 14, as will be discussed.

In an exemplary embodiment, each motorized omni wheel of the one or more motorized omni wheels may be coupled to a motor, where the motor may be configured to drive a rotational movement of the main wheel of each motorized omni wheel of the one or more motorized omni wheels about a normal axis of the main wheel. For example, first motorized omni wheel 30 may be coupled to a motor 44, where motor 44 may be configured to drive a rotational movement of main wheel 34 of first motorized omni wheel 30 about a normal axis 46 of main wheel 34. In an exemplary embodiment, motor 44 may include a drive shaft 48 that may be received and coupled within central bore 36 of main wheel 34.

Figure 4D:
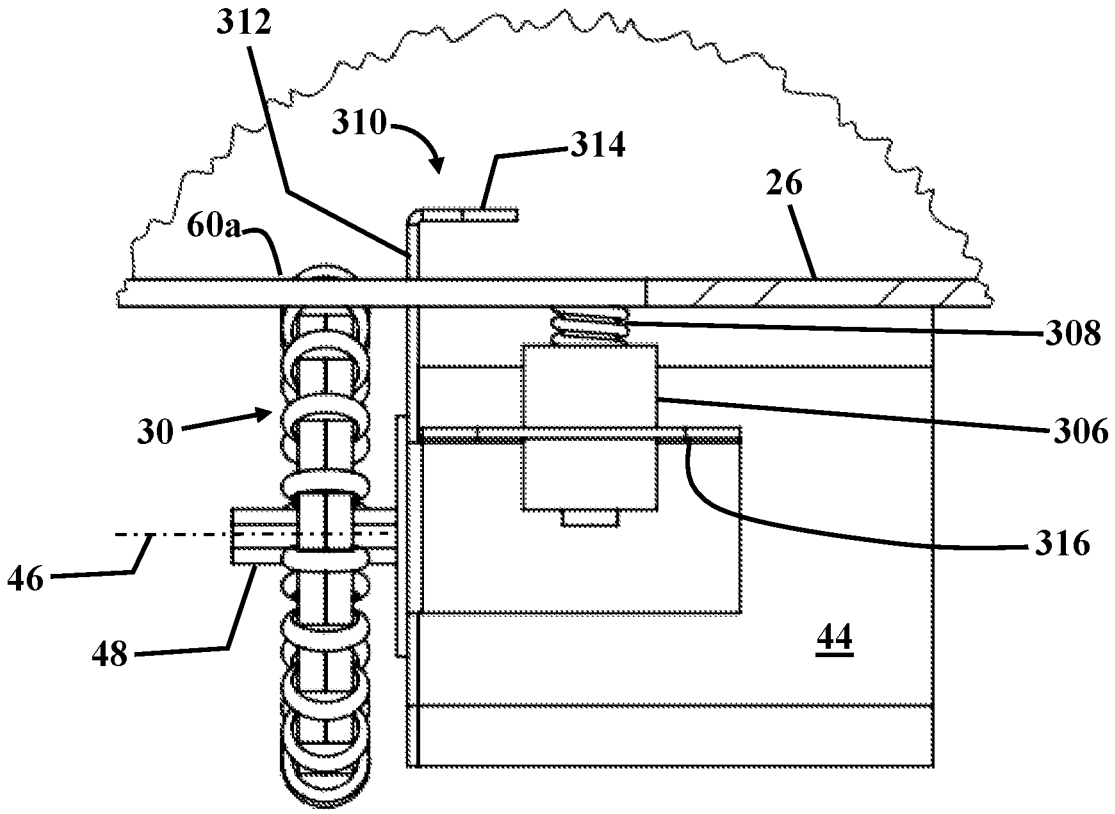
FIG. 4D illustrates a sectional side view of a first motorized omni wheel, consistent with one or more exemplary embodiments of the present disclosure.

FIG. 4D illustrates a sectional side view of first motorized omni wheel 30, consistent with one or more exemplary embodiments of the present disclosure. In an exemplary embodiment, each motorized omni wheel of the one or more motorized omni wheels may be attached to bottom surface 28 of tray 22 by utilizing a respective first suspension assembly and a respective second suspension assembly. Each suspension assembly of the first and second suspension assemblies may include a guide shaft that may be fixedly attached to bottom surface 28 and a linear bearing unit that may be utilized to couple a compression spring around the guide shaft with each motorized omni wheel of the one or more motorized omni wheels. The compression spring may be mounted around the guide shaft. For example, first motorized omni wheel 30 may be attached to bottom surface 28 of tray 22 by utilizing a first suspension assembly 300 and a second suspension assembly 300'. In an exemplary embodiment, first suspension assembly 300 may include a first guide shaft 304 that may be fixedly attached to bottom surface 28 of tray 22. First suspension assembly 300 may further include a first linear bearing unit 306 that may be attached to a first side of first motorized omni wheel 30 and a first compression spring 308 mounted around first guide shaft 304 and coupled with first motorized omni wheel 30 via first linear bearing unit 306. In an exemplary embodiment, second suspension assembly 300' may include a second guide shaft 304' that may be fixedly attached to bottom surface 28 of tray 22. Second suspension assembly 300' may further include a second linear bearing unit 306' that may be attached to a second opposing side of first motorized omni wheel 30 and a second compression spring 308' mounted around second guide shaft 304' and coupled with first motorized omni wheel 30 via second linear bearing unit 306'. In an exemplary embodiment, each linear bearing unit of the first and second linear bearing units may be attached to a respective side of each motorized omni wheel by a respective mounting plate attached to a respective side of each motorized omni wheel. For example, first linear bearing unit 306 may be mounted at the first side of first motorized omni wheel 30 utilizing first mounting plate 316.

In an exemplary embodiment, such attachment of each motorized omni wheel of the one or more motorized omni wheels utilizing such spring-loaded suspension assemblies may ensure a constant and uninterrupted engagement of the one or more motorized omni wheels with a top surface of workpiece 18.

In an exemplary embodiment, each motorized omni wheel of the one or more motorized omni wheels may further be coupled with tray 22 via an L-shaped holder that may extend upward from each motorized omni wheel of the one or more motorized omni wheels through a respective slit of tray 22 above that motorized omni wheel of the one or more motorized omni wheels. For example, first motorized omni wheel 30 may further be coupled with tray 22 via a first L-shaped holder 310. In an exemplary embodiment, first L-shaped holder may include an extended perpendicular portion 312 that may be attached to first motorized omni wheel 30 and may extend upward through slit 60*a*. In an exemplary embodiment, first L-shaped holder may further include a laterally extended portion 314 that may be positioned above tray 22. In an exemplary embodiment, laterally extended portion 314 may engage top surface 26 of tray 22 in response to tray 22 being moved upwardly along longitudinal axis 142.

In an exemplary embodiment, workpiece support base 16 may include a flat surface 50 that may support workpiece 18 on top of flat surface 50, where workpiece 18 may be moveable relative to flat surface 50. In an exemplary embodiment, workpiece 18 being moveable relative to flat surface 50 may refer to a slipping motion of workpiece 18 relative to flat surface 50. In an exemplary embodiment, a plain of rotation of tray 22 may be parallel with flat surface 50 of workpiece support base 16. In an exemplary embodiment, the plurality of idler wheels of each motorized omni wheel of the one or more omni wheels together may form circumferential engagement surfaces of that motorized omni wheel, and workpiece 18 may be supported between flat surface 50 and circumferential engagement surfaces of each motorized omni wheel of the one or more motorized omni wheels. For example, plurality of idler wheels 42 of first motorized omni wheel 30 together may form circumferential engagement surfaces 45 of first motorized omni wheel 30, and workpiece 18 may be supported between flat surface 50 and circumferential engagement surfaces 45 of first motorized omni wheel 30.

As mentioned in the preceding paragraphs, in an exemplary embodiment, each motorized omni wheel of the one or more motorized omni wheels being engaged with workpiece 18 may refer to no slip between an outer surface, or as is referred to here, circumferential engagement surface of each motorized omni wheel of the one or more motorized omni wheels and workpiece 18. No slip condition may refer to each motorized omni wheel of the one or more motorized omni wheels not slipping on workpiece 18. In an exemplary embodiment, the one or more motorized omni wheels not slipping on workpiece 18 may refer to the one or more motorized omni wheels pressing down workpiece 18 onto workpiece support base 16. When the one or more motorized omni wheels rotate, they may grab workpiece 18 and move it relative to sewing head 14 on workpiece support base 16. For example, first motorized omni wheel 30 not slipping on workpiece 18 may refer to first motorized omni wheel 30 pressing down workpiece 18 onto workpiece support base 16 such that here will be no slipping between motorized omni wheel 30 and workpiece 18 along a direction perpendicular to normal axis 46. Consequently, when first motorized omni wheel 30 may be rotated by motor 44 in a direction shown by arrow 47, circumferential engagement surfaces 45 of first motorized omni wheel 30 may force workpiece 18 to move on workpiece support base 16 in a direction shown by arrow 49.

In an exemplary embodiment, such arrangement of first motorized omni wheel 30 and second motorized omni wheel 32 of first actuating mechanism 21, as discussed above, may allow for first actuating mechanism 21 to drive a translational movement of workpiece 18 relative to sewing head 14 along a translational axis perpendicular to the normal axes of first motorized omni wheel 30 and second motorized omni wheel 32. For example, for performing straight line stiches, first actuating mechanism 21 may be configured to move workpiece 18 in a straight direction along the aforementioned translational axis by urging the respective motors of first motorized omni wheel 30 and second motorized omni wheel 32 to drive rotational movements of first motorized omni wheel 30 and second motorized omni wheel 32 about their respective normal axes.

In an exemplary embodiment, first actuating mechanism 21 may further include one or more auxiliary idler wheels, such as a first auxiliary idler wheel 64 and a second auxiliary idler wheel 66 that may be attached to bottom surface 28 of tray 22. In an exemplary embodiment, first auxiliary idler wheel 64 may be attached to bottom surface 28 via a first mounting frame 640 and second auxiliary idler wheel 66 may be attached to bottom surface 28 via a second mounting frame 660.

Figure 4E:
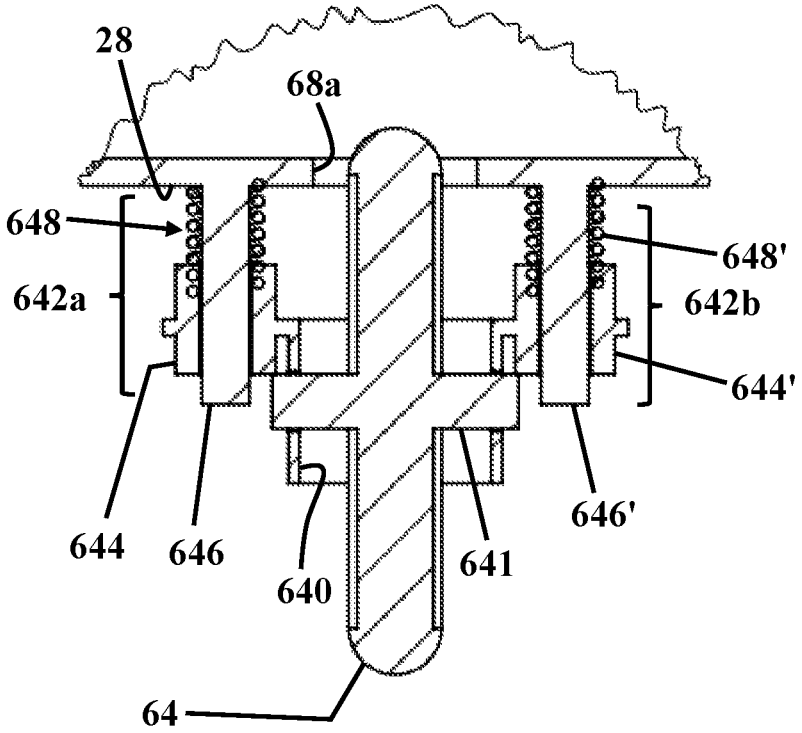
FIG. 4E illustrates a sectional side view of a first idler wheel, consistent with one or more exemplary embodiments of the present disclosure.

FIG. 4E illustrates a sectional side view of first auxiliary idler wheel 64, consistent with one or more exemplary embodiments of the present disclosure. In an exemplary embodiment, first mounting frame 640 may be attached to bottom surface 28 of tray 22 via two suspension assemblies (642*a*, 642*b*) at opposing sides of first mounting frame 640. In an exemplary embodiment, each suspension assembly of two suspension assemblies (642*a*, 642*b*) may include a respective linear bearing unit, a respective guide shaft, and a respective compression spring. For example, suspension assembly 642*a* may include a linear bearing unit 644, a guide shaft 646, and a compression spring 648. For example, suspension assembly 642*b* may include a linear bearing unit 644', a guide shaft 646', and a compression spring 648'. In an exemplary embodiment, each idler wheel of one or more auxiliary idler wheels may be rotatably mounted on a respective shaft, which may be rotatably coupled with each respective mounting frame. For example, first auxiliary idler wheel 64 may be rotatably mounted on first mounting frame 640 via first shaft 641.

In an exemplary embodiment, second mounting frame 660 may be attached to bottom surface 28 of tray 22 via two suspension assemblies (662*a*, 662*b*) at opposing sides of second mounting frame 660. In an exemplary embodiment, suspension assemblies (662*a*, 662*b*) may be structurally similar to suspension assemblies (642*a*, 642*b*) and their respective structures are not described in detail for simplicity.

In an exemplary embodiment, first auxiliary idler wheel 64 and second auxiliary idler wheel 66 may be in contact with a top surface of workpiece 18 similar to the one or more motorized omni wheels. In an exemplary embodiment, first auxiliary idler wheel 64 and second auxiliary idler wheel 66 may further push down on workpiece 18 and may thereby prevent any wrinkles from forming on workpiece 18 when first actuating mechanism 21 is moving workpiece 18.

In an exemplary embodiment, tray 22 may further include two auxiliary slits (68*a* and 68*b*) that may allow for top halves of first auxiliary idler wheel 64 and second auxiliary idler wheel 66 to be accommodated within two auxiliary slits (68*a* and 68*b*). In an exemplary embodiment, under each slit, a pair of parallel flanges may be attached to bottom surface 28 of tray 22 and a respective auxiliary idler wheel may be supported on a respective shaft of that auxiliary idler wheel. For example, a pair of parallel flanges may be attached under slit 68*a* to bottom surface 28 of tray 22. A shaft may be rotatably supported between the pair of parallel flanges and first auxiliary idler wheel 64 may be rotatably coupled with the shaft.

In an exemplary embodiment, second actuating mechanism 23 may include a rotary motor 52 that may be mounted in a fixed position relative to sewing head 14, and a timing belt 54 coupled between rotary motor 52 and tray 22, where timing belt 54 may be configured to transfer a rotational movement of rotary motor 52 to tray 22. In an exemplary embodiment, timing belt 54 may be configured to drive a rotational movement of tray 22 about longitudinal axis 142 of extended sewing needle 140 by transferring the rotational movement of rotary motor 52 to tray 22. In an exemplary embodiment, rotary motor 52 may be fixedly mounted on computerized sewing machine 10 utilizing a mounting platform 74. In an exemplary embodiment, second actuating mechanism 23 may further include a mounting ring 76 that may be attached to either rotary motor 52 directly or to mounting platform 74. In an exemplary embodiment, tray 22 may include a disc 220 with top surface 26 and opposing bottom surface 28 and an annular wall 222 extending upward from top surface 26 of disc 220 and an annular lip 224 integrally formed on top of annular wall 222. In an exemplary embodiment, mounting ring 76 may function as both a guide for timing belt and as an annular shoulder, on top of which annular lip 224 may rest. In an exemplary embodiment, annular lip 224 may rest upon mounting ring 76 via a thrust bearing unit 760. In an exemplary embodiment, mounting ring 76 may include an annular thrust bearing groove 762 in which a plurality of thrust bearing balls 764 of thrust bearing unit 760 may be disposed. In an exemplary embodiment, annular lip 224 may include a corresponding annular thrust bearing groove 226 in which a top portion of the plurality of thrust bearing balls 764 of thrust bearing unit 760 may be supported. In an exemplary embodiment, such coupling of thrust bearing unit 760 between annular lip 224 of tray 22 and mounting ring 76 may facilitate a rotational movement of tray 22 with respect to mounting ring 76.

In an exemplary embodiment, each motorized omni wheel of the one or more motorized omni wheels may be rotatable with tray 22 about longitudinal axis 142 of extended sewing needle 140. For example, first motorized omni wheel 30 may be rotatable with tray 22 about longitudinal axis 142 of extended sewing needle 140. In an exemplary embodiment, longitudinal axis 142 of extended sewing needle 140 may be superimposed on plane of rotation of main wheel 34 of first motorized omni wheel 30.

Figure 6:
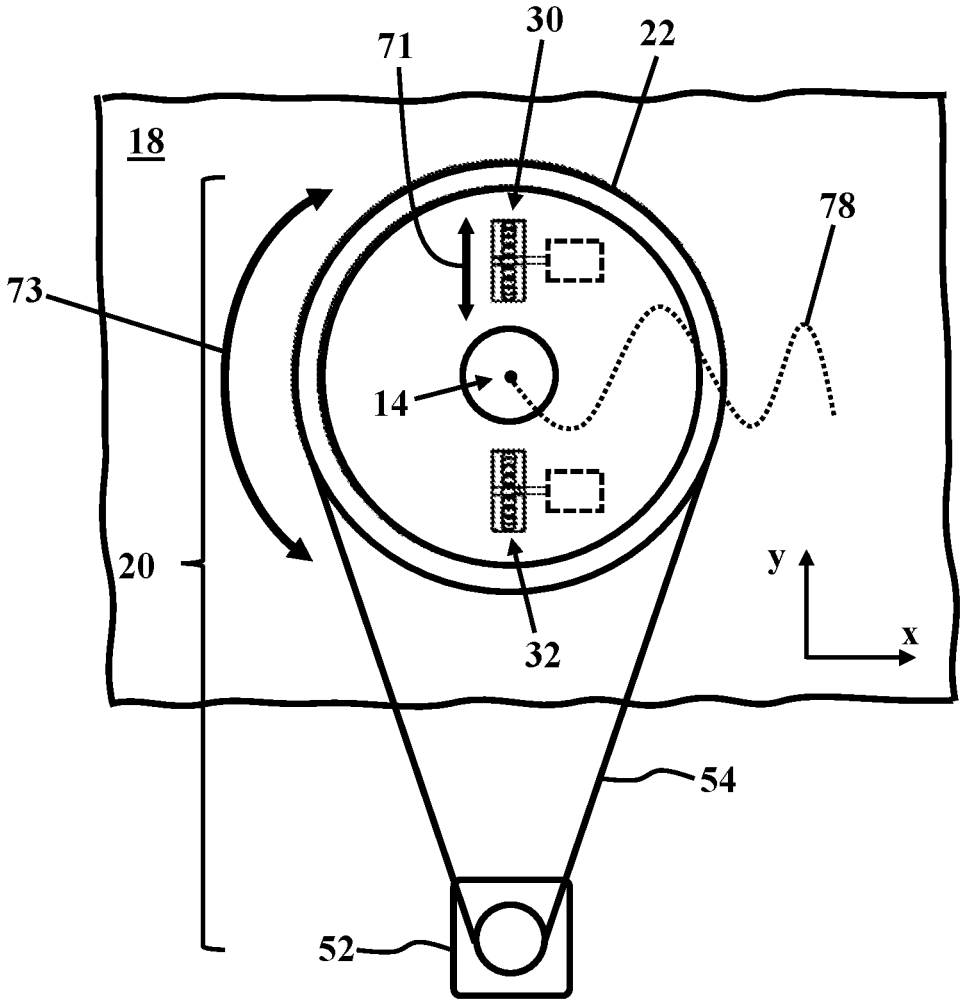
FIG. 6 illustrates a schematic top view of a workpiece moving assembly and a workpiece, consistent with one or more exemplary embodiments of the present disclosure.

FIG. 6 illustrates a schematic top view of workpiece moving assembly 20 and workpiece 18, consistent with one or more exemplary embodiments of the present disclosure. In an exemplary embodiment, in order to apply a curved stitching on workpiece 18, such as stitching path 78, workpiece 18 must be moved with respect to sewing head 14. As mentioned before, in an exemplary embodiment, first actuating mechanism 21 of workpiece moving assembly 20 may be utilized to drive a translational movement of workpiece 18 with respect to sewing head 14 along a direction shown by arrow 71 and second actuating mechanism 23 of workpiece moving assembly 20 may be utilized to drive a rotational movement of first actuating mechanism 21 about longitudinal axis 142 of sewing head 14 along a rotational direction shown by arrow 73. In exemplary embodiments, such configuration of first actuating mechanism 21 and second actuating mechanism 23 of workpiece moving assembly 20 may allow for moving workpiece 18 with respect to sewing head 14 along two perpendicular axes (x and y) and that way a curved and long stich such as stitching path 78 may be performed on a workpiece such as workpiece 18. In other words, first actuating mechanism 21 that may include first motorized omni wheel 30 and second motorized omni wheel 32 may drive a translational movement of workpiece 18 with respect to sewing head 14 along a straight translational direction as shown by arrow 71. Second actuating mechanism 23 that may include rotary motor 52 coupled with tray 22 may drive a rotational movement of tray 22 about longitudinal axis of sewing head 14 in order to change the straight translational direction along which first actuating mechanism 21 moves workpiece 18.

In an exemplary embodiment, each motorized omni wheel of the one or more motorized omni wheels of first actuating mechanism 21, for example, first motorized omni wheel 30 and second motorized omni wheel 32 may only be engaged with workpiece 18 in a no slip manner when moving along the straight translational direction 71. While plurality of idler wheels of each respective motorized omni wheel of the one or more motorized omni wheels may allow for each motorized omni wheel to rotate freely on workpiece 18 about longitudinal axis 142 of sewing head 14 without forcing workpiece 18 to rotate about longitudinal axis 142. Such configuration of the plurality of idler wheels of each motorized omni wheel may allow for changing the straight translational direction of each motorized omni wheel about sewing head 14 without forcing workpiece 18 to rotate about longitudinal axis 142 of sewing head 14.

In an exemplary embodiment, computerized sewing machine 10 may further include a controller 56 that may either be mounted on computerized sewing machine 10 or on a sewing table, on which computerized sewing machine 10 may also be mounted. In an exemplary embodiment, controller 56 may be coupled with workpiece moving assembly 20 and may be configured to urge workpiece moving assembly 20 to move workpiece 18 relative to sewing head 14 on workpiece support base 16 in accordance with a set of computerized sewing instructions. In an exemplary embodiment, controller 56 may include at least one memory that may be configured to store a set of computerized sewing instructions, where the computerized sewing instructions may correspond to a plurality of sewing patterns. In an exemplary embodiment, controller 56 may further include at least one processor that may be coupled with the at least one memory. In an exemplary embodiment, the at least one processor may be configured to read the computerized sewing instructions from the at least one memory and to urge workpiece moving assembly 20 to move workpiece 18 relative to sewing head 14 on workpiece support base 16 in accordance with the read computerized sewing instructions.

In an exemplary embodiment, computerized sewing machine 10 may further include a user interface unit 58 that may be configured to receive data input from a user. In an exemplary embodiment, user interface unit 58 may include, for example, a human machine interface (HMI) unit. In an exemplary embodiment, user interface unit 58, in combination with controller 56, may allow a user to either input a set of computerized sewing instructions or choose a computerized sewing instruction from a plurality of computerized sewing instructions already stored on the at least one memory. In an exemplary embodiment, controller 56 may be connected to user interface unit 58 through, for example, wired links, wireless links, or a combination of wired and wireless links.

In an exemplary embodiment, since one or more motorized omni wheels, such as first motorized omni wheel 30 and second motorized omni wheel 32 may be mounted on rotating tray 22, a slip ring 94 may be utilized for transmission of power and electrical signals to rotating tray 22. In an exemplary embodiment, slip ring 94 may include a connector 940 that may be mounted on mounting ring 76 and a plurality of connection rings 942 that may be mounted on circumferential grooves on annular lip 224 of tray 22. In an exemplary embodiment, connector 940 may include graphite brushes that may brush against connection rings 942 and thereby allow for transmission of power and electrical signals to first actuating mechanism 21.

Figure 7:
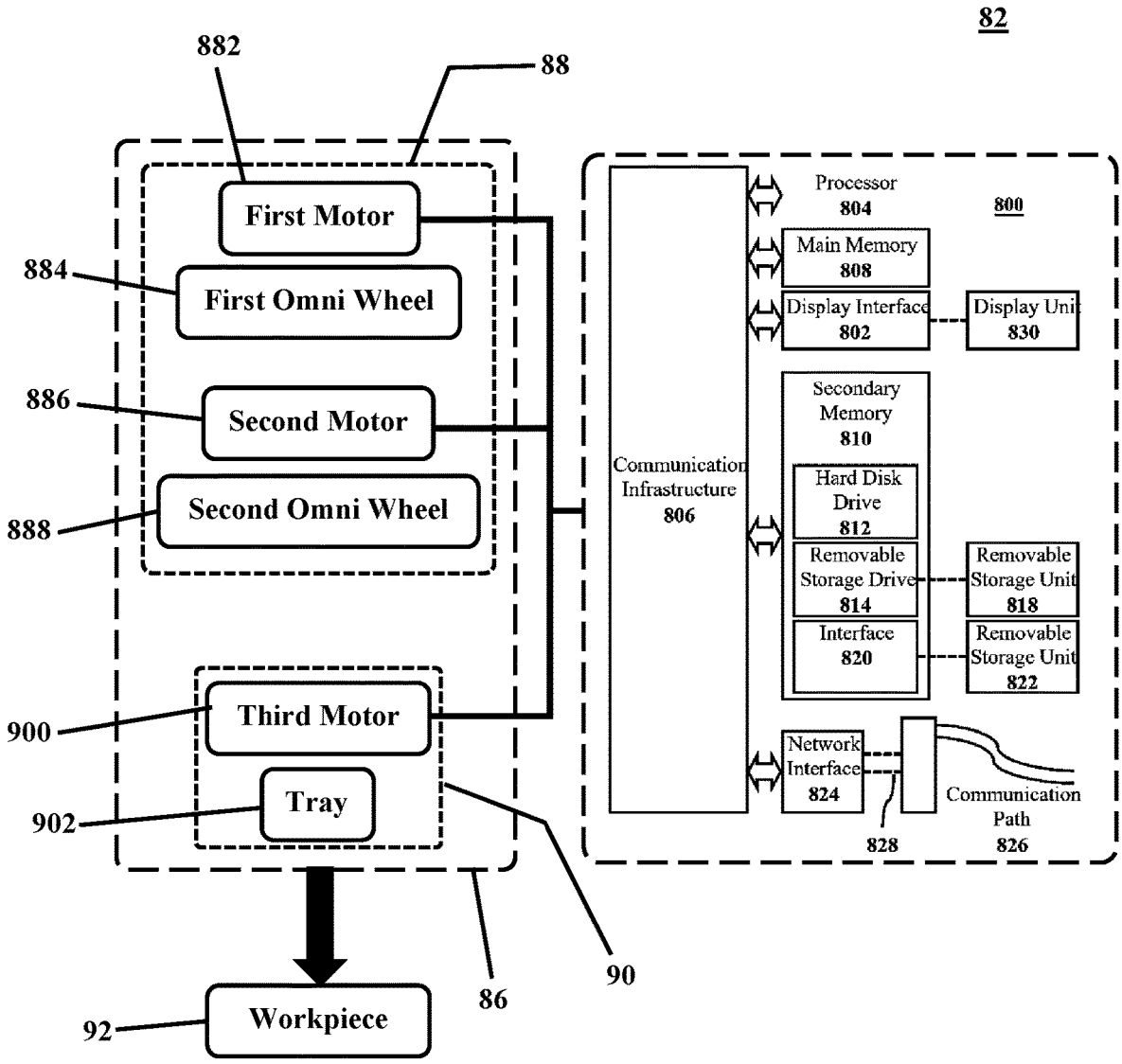
FIG. 7 illustrates a block diagram of a computerized sewing system, consistent with one or more exemplary embodiments of the present disclosure.

FIG. 7 illustrates a block diagram of a computerized sewing system 82, consistent with one or more exemplary embodiments of the present disclosure. In an exemplary embodiment, computerized sewing system 82 may be implemented as computerized sewing machine 10.

In an exemplary embodiment, computerized sewing system 82 may include a controller 800 that may be similar to controller 56 that may be coupled with a sewing machine that may be similar to computerized sewing machine 10. In an exemplary embodiment, sewing machine may include a workpiece moving assembly 86 that may be similar to workpiece moving assembly 20. In an exemplary embodiment, workpiece moving assembly 86 may include a first actuating mechanism 88 and a second actuating mechanism 90. In an exemplary embodiment, first actuating mechanism 88 may include a first motor 880 coupled with a first omni wheel 882 similar to first motorized omni wheel 30 and a second motor 884 coupled with a second omni wheel 886 similar to second motorized omni wheel 32. In an exemplary embodiment, second actuating mechanism 90 may include a third motor 900 that may be coupled to a tray 902 similar to rotary motor 52 that was coupled with tray 22 via timing belt 54. In an exemplary embodiment, workpiece moving assembly 86 may be coupled with a workpiece 92 such as a piece of textile or leather that may be similar to workpiece 18. In an exemplary embodiment, workpiece moving assembly 86 may provide an angular degree of freedom and a radial degree of freedom for the movement of workpiece 92 relative to a sewing head similar to sewing head 14.

Figure 8A:
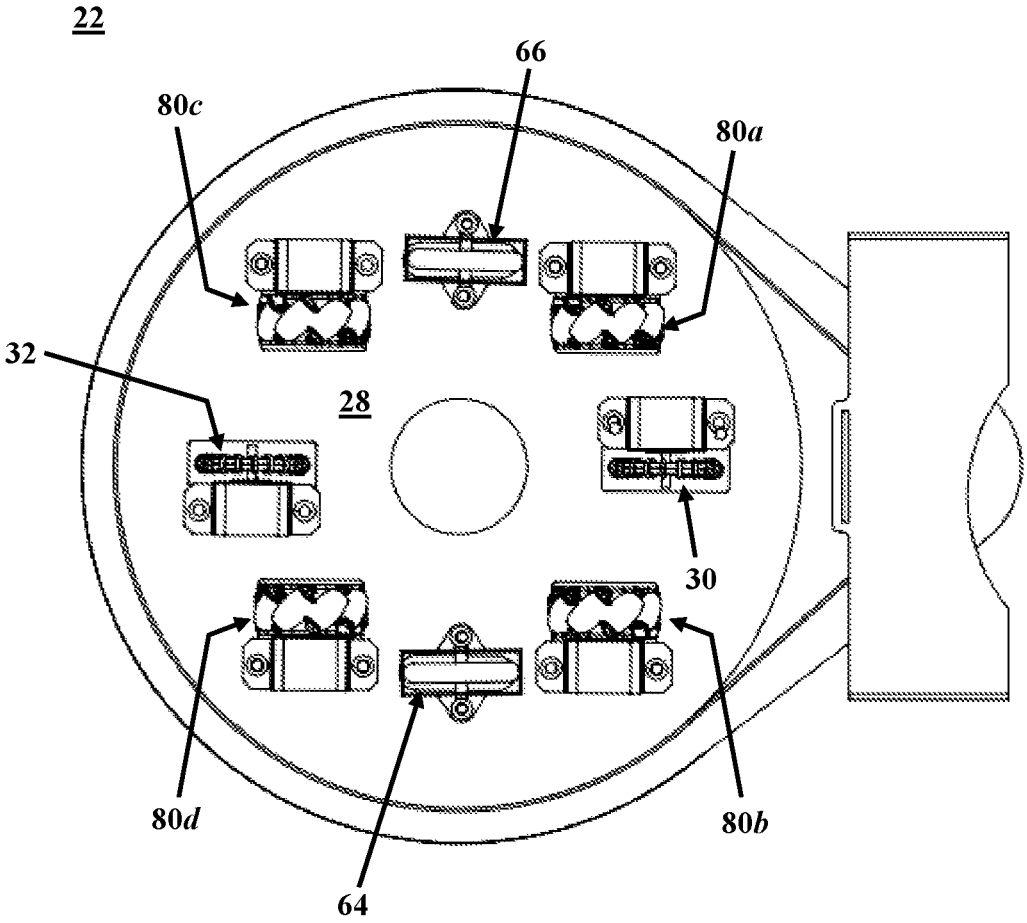
FIG. 8A illustrates a bottom view of tray, consistent with one or more exemplary embodiments of the present disclosure.

FIG. 8A illustrates a bottom view of tray 22, consistent with one or more exemplary embodiments of the present disclosure. In an exemplary embodiment, additional wheels, such as Mecanum wheels 80*a*-80*d* may further be attached to bottom surface 28 of tray 22 along with first motorized omni wheel 30, second motorized omni wheel 32, first auxiliary idler wheel 64, and second auxiliary idler wheel 66. In an exemplary embodiment, Mecanum wheels 80*a*-80*d* may be structurally similar.

Figure 8B:
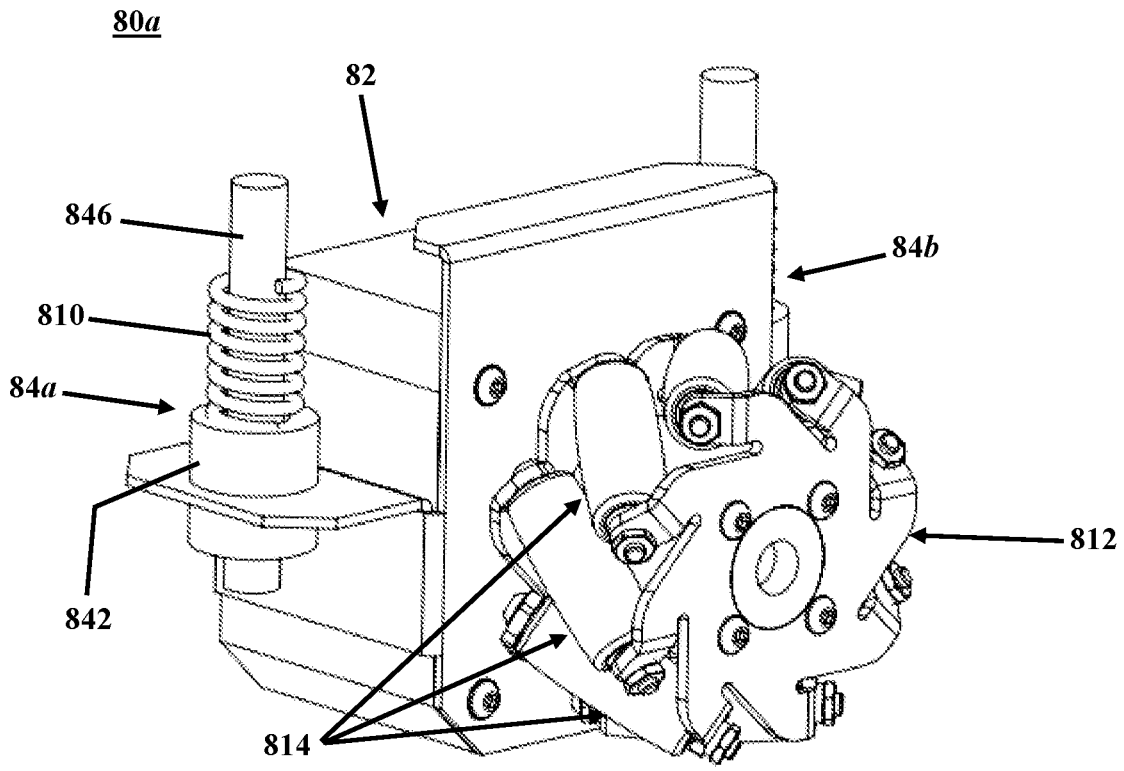
FIG. 8B illustrates a perspective view of a Mecanum wheel, consistent with one or more exemplary embodiments of the present disclosure.

FIG. 8B illustrates a perspective view of Mecanum wheel 80*a*, consistent with one or more exemplary embodiments of the present disclosure. In an exemplary embodiment, each Mecanum wheel of Mecanum wheels 80*a*-80*d* may be rotatably coupled with bottom surface 28 of tray 22 via a respective mounting frame. For example, Mecanum wheel 80*a* may be rotatably coupled with bottom surface 28 of tray 22 via a mounting frame 82. In an exemplary embodiment, mounting frame 82 may be attached to bottom surface 28 of tray 22 via two suspension assemblies (84*a*, 84*b*) at opposing sides of mounting frame 82. In an exemplary embodiment, each suspension assembly of two suspension assemblies (84*a*, 84*b*) may include a respective linear bearing unit, a respective guide shaft, and a respective compression spring. For example, suspension assembly 84*a* may include a linear bearing unit 842, a guide shaft 846, and a compression spring 810. In an exemplary embodiment, each Mecanum wheel of Mecanum wheels 80*a*-80*d* may include a main rotatable frame and a plurality of idle rollers mounted on a periphery of the main rotatable frame. For example, Mecanum wheel 80*a* may include a main rotatable frame 812 and a plurality of idle rollers 814 mounted on a periphery of main rotatable frame 812. In an exemplary embodiment, each idle roller of plurality of idle rollers 814 may be oriented with a 45° angle with respect to a rotational plane of main rotatable frame 812.

In an exemplary embodiment, such addition of Mecanum wheels 80*a*-80*d* or other similar idle or motorized wheels to tray 22 may allow for exerting more contact force between workpiece moving assembly 20 and workpiece 18 and may further allow for a better distribution of contact force on a top surface of workpiece 18. Such increase in contact force and improvement in the distribution of contact force between workpiece moving assembly 20 and workpiece 18 due to the presence of more wheels under tray 22 may be especially beneficial in case of a workpiece 18 made of a thick and heavy textile that may require more force to be moved by workpiece moving assembly 20.

In an exemplary embodiment, controller 800 may be implemented as a computer system, in which an embodiment of the present disclosure, or portions thereof, may be implemented as computer-readable code, consistent with exemplary embodiments of the present disclosure. For example, computerized sewing instructions may be implemented in controller 800 using hardware, software, firmware, tangible computer-readable media having instructions stored thereon, or a combination thereof and may be implemented in one or more computer systems or other processing systems.

If programmable logic is used, such logic may execute on a commercially available processing platform or a special purpose device. One ordinary skill in the art may appreciate that an embodiment of the disclosed subject matter may be practiced with various computer system configurations, including multi-core multiprocessor systems, minicomputers, mainframe computers, computers linked or clustered with distributed functions, as well as pervasive or miniature computers that may be embedded into virtually any device.

For instance, a computing device having at least one processor device and a memory may be used to implement the above-described embodiments. A processor device may be a single processor, a plurality of processors, or combinations thereof. Processor devices may have one or more processor "cores."

An embodiment of the disclosure is described in terms of this example controller 800. After reading this description, it will become apparent to a person skilled in the relevant art how to implement the disclosure using other computer systems and/or computer architectures. Although operations may be described as a sequential process, some of the operations may be performed in parallel, concurrently, and/or in a distributed environment, and with program code stored locally or remotely for access by single or multiprocessor machines. Also, in some embodiments, the order of operations may be rearranged without departing from the spirit of the disclosed subject matter.

Processor device 804 may be a special purpose or a general-purpose processor device. As will be appreciated by persons skilled in the relevant art, processor device 804 may also be a single processor in a multi-core/multiprocessor system, such system operating alone, or in a cluster of computing devices operating in a cluster or server farm. Processor device 804 may be connected to a communication infrastructure 806, for example, a bus, message queue, network, or multi-core message-passing scheme.

In an exemplary embodiment, controller 800 may include a display interface 802, for example, a video connector, to transfer data to a display unit 830, for example, a monitor. Controller 800 may also include a main memory 808, for example, random access memory (RAM), and may also include a secondary memory 810. Secondary memory 810 may include, for example, a hard disk drive 812, and a removable storage drive 814. Removable storage drive 814 may include a floppy disk drive, a magnetic tape drive, an optical disk drive, a flash memory, or the like. Removable storage drive 814 may read from and/or write to a removable storage unit 818 in a well-known manner. Removable storage unit 818 may include a floppy disk, a magnetic tape, an optical disk, etc., which may be read by and written to by removable storage drive 814. As will be appreciated by persons skilled in the relevant art, removable storage unit 818 may include a computer-usable storage medium having stored therein computer software and/or data.

In alternative implementations, secondary memory 810 may include other similar means for allowing computer programs or other instructions to be loaded into controller 800. Such means may include, for example, a removable storage unit 822 and an interface 820. Examples of such means may include a program cartridge and cartridge interface (such as that found in video game devices), a removable memory chip (such as an EPROM, or PROM) and associated socket, and other removable storage units 822 and interfaces 820 which allow software and data to be transferred from removable storage unit 822 to controller 800.

Controller 800 may also include a communications interface 824. Communications interface 824 allows software and data to be transferred between controller 800 and external devices. Communications interface 824 may include a modem, a network interface (such as an Ethernet card), a communications port, a PCMCIA slot, and card, or the like. Software and data transferred via communications interface 824 may be in the form of signals, which may be electronic, electromagnetic, optical, or other signals capable of being received by communications interface 824. These signals may be provided to communications interface 824 via a communications path 826. Communications path 826 carries signals and may be implemented using wire or cable, fiber optics, a phone line, a cellular phone link, an RF link or other communications channels.

In an exemplary embodiment, computerized sewing instructions programs (also called computer control logic) may be stored in main memory 808 and/or secondary memory 810 as computer programs (also called computer control logic). Computer programs may also be received via communications interface 824. Such computer programs, when executed, enable controller 800 to implement different embodiments of the present disclosure as discussed herein. In particular, the computer programs, when executed, enable processor device 804 to implement the processes of the present disclosure, such as the operations in computerized sewing machine 10. Accordingly, such computer programs represent controllers of controller 800. The software may be stored in a computer program product and loaded into controller 800 using removable storage drive 814, interface 820, and hard disk drive 812, or communications interface 824.

Embodiments of the present disclosure also may be directed to computer program products including software stored on any computer useable medium. Such software, when executed in one or more data processing devices, causes a data processing device to operate as described herein. An embodiment of the present disclosure may employ any computer useable or readable medium. Examples of computer useable mediums include, but are not limited to, primary storage devices (e.g., any type of random-access memory), secondary storage devices (e.g., hard drives, floppy disks, CD ROMS, ZIP disks, tapes, magnetic storage devices, and optical storage devices, MEMS, nanotechnological storage device, etc.).

In an exemplary embodiment, controller 800 may be coupled to first motor 880, second motor 884 and third motor 900 of workpiece moving assembly 86. In an exemplary embodiment, controller 800 may further be configured to utilize the radial and angular degrees of freedom provided by first actuating mechanism 88 and second actuating mechanism 90 to move workpiece 92 relative to sewing head 14 based on the desired stitching pattern. Specifically, controller 800 may urge first motor 880 and second motor 884 to actuate translational movements of workpiece 92 along the radial degree of freedom via first omni wheel 882 and second omni wheel 886. Controller 800 may further urge third motor 900 to actuate rotational movements of first motor 880 and second motor 884 along the angular degree of freedom via tray 902.

The embodiments have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the disclosure that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for description and not of limitation, such that the terminology or phraseology of the present specification is to be interpreted by the skilled artisan in light of the teachings and guidance.

The breadth and scope of the present disclosure should not be limited by any of the above-described exemplary embodiments but should be defined only in accordance with the following claims and their equivalents.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps. Moreover, the word "substantially" when used with an adjective or adverb is intended to enhance the scope of the particular characteristic, e.g., substantially planar is intended to mean planar, nearly planar and/or exhibiting characteristics associated with a planar element. Further use of relative terms such as "vertical", "horizontal", "up", "down", and "side-to-side" are used in a relative sense to the normal orientation of the apparatus.

What is claimed is:

1. A computerized sewing machine, comprising:

a workpiece supporting base comprising a flat surface supporting a workpiece on top of the flat surface, the workpiece moveable relative to the flat surface;

a sewing head comprising an elongated sewing needle, a longitudinal axis of the sewing needle perpendicular to the workpiece supporting base;

a workpiece moving assembly configured to move the workpiece relative to the sewing head on the workpiece supporting base, the workpiece moving assembly comprising:

a first actuating mechanism configured to drive a translational movement of the workpiece relative to the sewing head, the first actuating mechanism comprising:

an annular tray comprising a central hole, a top surface of the annular tray facing away from the workpiece supporting base and an opposing bottom surface of the annular tray facing the workpiece supporting base; and at least one motorized omni wheel attached to the bottom surface of the annular tray, the at least one motorized omni wheel comprising:

a main wheel comprising a central bore, the main wheel extending radially outward from an inner rim provided by the central bore to an outer periphery rim; and a plurality of idler wheels rotatably mounted on the outer periphery rim of the main wheel, the plurality of idler wheels peripherally spaced and laterally rotatable, a lateral plane of rotation of each idler wheel of the plurality of the idler wheels perpendicular to a plane of rotation of the main wheel, a plain of rotation of the main wheel perpendicular to a diameter of the annular tray, wherein the at least one motorized omni wheel is further coupled to a motor, the motor configured to drive a rotational movement of the main wheel about a normal axis of the main wheel, the motor comprising a drive shaft received and coupled within the central bore of the main wheel, wherein, the central hole is configured to allow for the sewing head to pass through the central hole; and a second actuating mechanism configured to drive a rotational movement of the first actuating mechanism relative to the sewing head about a longitudinal axis of the sewing head, the second actuating mechanism comprising:

a rotary motor mounted in a fixed position relative to the sewing head; and a timing belt coupled between the rotary motor and the tray, the timing belt configured to drive a rotational movement of the tray about the longitudinal axis of the sewing needle by transferring the rotational movement of the rotary motor to the tray; and a controller coupled with the workpiece moving assembly, the controller comprising:

at least one memory configured to store computerized sewing instructions, the computerized sewing instructions corresponding to a plurality of sewing patterns; and at least one processor coupled with the at least one memory, the at least one processor configured to read the computerized sewing instructions from the at least one memory, the at least one processor further configured to urge the workpiece moving assembly to move the workpiece relative to the sewing head on the workpiece supporting base in accordance with the computerized sewing instructions.

2. A computerized sewing machine, comprising:
a workpiece supporting base;
a sewing head;
a workpiece moving assembly configured to move the workpiece relative to the sewing head on the workpiece supporting base, the workpiece moving assembly comprising:
a first actuating mechanism configured to drive a translational movement of the workpiece relative to the sewing head, the first actuating mechanism comprising:
a tray comprising a central hole, a top surface of the tray facing away from the workpiece supporting base and an opposing bottom surface of the tray facing the workpiece supporting base; and
at least one motorized omni wheel attached to the bottom surface of the tray, a plain of rotation of the at least one motorized omni wheel perpendicular to a plane of rotation of the tray,
wherein, the central hole is configured to allow for the sewing head to pass through the central hole; and
a second actuating mechanism configured to drive a rotational movement of the first actuating mechanism relative to the sewing head about a longitudinal axis of the sewing head, the second actuating mechanism comprising:
a rotary motor mounted in a fixed position relative to the sewing head; and
a timing belt coupled between the rotary motor and the tray, the timing belt configured to transfer a rotational movement of the rotary motor to the tray; and
a controller coupled with the workpiece moving assembly, the controller comprising:
at least one memory configured to store computerized sewing instructions, the computerized sewing instructions corresponding to a plurality of sewing patterns; and
at least one processor coupled with the at least one memory, the at least one processor configured to read the computerized sewing instructions from the at least one memory, the at least one processor further configured to urge the workpiece moving assembly to move the workpiece relative to the sewing head on the workpiece supporting base in accordance with the computerized sewing instructions.

3. The computerized sewing machine of claim 2, wherein the at least one motorized omni wheel comprises:
a main wheel comprising a central bore, the main wheel extending radially outward from an inner rim provided by the central bore to an outer periphery rim; and
a plurality of idler wheels rotatably mounted on the outer periphery rim of the main wheel, the plurality of idler wheels peripherally spaced and laterally rotatable, a lateral plane of rotation of each idler wheel of the plurality of the idler wheels perpendicular to a plane of rotation of the main wheel.

4. The computerized sewing machine of claim 3, wherein the at least one motorized omni wheel is further coupled to a motor, the motor configured to drive a rotational movement of the main wheel about a normal axis of the main wheel, the motor comprising a drive shaft received and coupled within the central bore of the main wheel.

5. The computerized sewing machine of claim 4, wherein the tray comprises an annular tray, an axis of rotation of the main wheel perpendicular to a diameter of the annular tray.

6. The computerized sewing machine of claim 5, wherein:
the workpiece supporting base comprises a flat surface supporting a workpiece on top of the flat surface, the workpiece moveable relative to the flat surface,
the plurality of idler wheels together form circumferential engagement surfaces of the motorized omni wheel, and
the workpiece supported between the flat surface and the circumferential engagement surfaces of the motorized omni wheel.

7. The computerized sewing machine of claim 6, wherein a plain of rotation of the tray is parallel with the flat surface of the workpiece supporting base.

8. The computerized sewing machine of claim 2, wherein the sewing head comprises an elongated sewing needle, a longitudinal axis of the sewing needle perpendicular to the workpiece supporting base, the timing belt configured to drive a rotational movement of the tray about the longitudinal axis of the sewing needle by transferring the rotational movement of the motor to the tray.

9. The computerized sewing machine of claim 8, wherein the at least one motorized omni wheel is rotatable with the tray about the longitudinal axis of the sewing needle.

10. The computerized sewing machine of claim 9, wherein the at least one motorized omni wheel comprises:
a main wheel comprising a central bore, the main wheel extending radially outward from an inner rim provided by the central bore to an outer periphery rim; and
a plurality of idler wheels rotatably mounted on the outer periphery rim of the main wheel, the plurality of idler wheels peripherally spaced and laterally rotatable, a lateral plane of rotation of each idler wheel of the plurality of the idler wheels perpendicular to a plane of rotation of the main wheel.

11. The computerized sewing machine of claim 10, wherein the longitudinal axis of the sewing needle is superimposed on the plane of rotation of the main wheel, the main wheel rotatable with the tray about the longitudinal axis of the sewing needle.

12. The computerized sewing machine of claim 11, wherein:
the workpiece supporting base comprises a flat surface supporting a workpiece on top of the flat surface, the workpiece moveable relative to the flat surface,
the plurality of idler wheels together form circumferential engagement surfaces of the motorized omni wheel, and
the workpiece supported between the flat surface and the circumferential engagement surfaces of the motorized omni wheel.

13. The computerized sewing machine of claim 12, wherein a plain of rotation of the tray is parallel with the flat surface of the workpiece supporting base.

14. The computerized sewing machine of claim 13, wherein a workpiece assumes a translational movement relative to the sewing head in response to the rotational movement of the motorized omni wheel.

15. The computerized sewing machine of claim 14, wherein the motorized omni wheel assumes a rotational movement relative to the sewing head about the longitudinal axis of the sewing head in response to the rotational movement of the tray about the longitudinal axis of the sewing head.

* * * * *